US006291908B1

(12) United States Patent
Tran et al.

(10) Patent No.: US 6,291,908 B1
(45) Date of Patent: Sep. 18, 2001

(54) MICRO-MINIATURE SWITCH APPARATUS

(75) Inventors: Dean Tran, Westminister; John Joseph Berenz, San Pedro; Luis M. Rochin, Temecula; Thomas J. Roth, Redondo Beach; Ronald A. DePace, Mission Viejo, all of CA (US)

(73) Assignee: TRW Inc., Lyndhurst, OH (US)

( * ) Notice: Subject to any disclaimer, the term of this patent is extended or adjusted under 35 U.S.C. 154(b) by 0 days.

(21) Appl. No.: 09/413,402

(22) Filed: Oct. 6, 1999

(51) Int. Cl.[7] ..... H01H 35/14

(52) U.S. Cl. ..... 307/112; 307/121; 307/10.1; 73/514.11; 73/514.24

(58) Field of Search ..... 307/112, 119, 307/120, 121, 10.1; 200/61.45, 181, 61.48, 61.49, 61.53; 257/414, 421, 422, 531; 73/514.16, 514.24, 514.29, 514.32, 514.33, 514.34; 361/233

(56) References Cited

U.S. PATENT DOCUMENTS

| | | | |
|---|---|---|---|
| 2,793,260 | 5/1957 | Ciosek | 200/61.45 |
| 3,618,402 | 11/1971 | Kase | 73/517 |
| 4,495,814 | 1/1985 | Steinke . | |
| 4,555,946 | 12/1985 | Capaldi et al. . | |
| 4,736,629 | 4/1988 | Cole . | |
| 4,882,933 | 11/1989 | Petersen et al. . | |
| 5,248,861 | 9/1993 | Kato et al. . | |
| 5,331,853 | 7/1994 | Hulsing, II . | |
| 5,541,437 | 7/1996 | Watanabe et al. . | |
| 5,591,910 | 1/1997 | Lin . | |
| 5,610,337 * | 3/1997 | Nelson | 73/651 |
| 5,635,739 | 6/1997 | Grieff et al. . | |
| 5,644,086 | 7/1997 | Cahill et al. . | |
| 5,804,783 | 9/1998 | Breed . | |
| 5,828,138 * | 10/1998 | McIver et al. | 307/10.1 |

* cited by examiner

*Primary Examiner*—Josie Ballato
*Assistant Examiner*—Robert Deberadinis
(74) *Attorney, Agent, or Firm*—Tarolli, Sundheim, Covell, Tummino & Szabo L.L.P.

(57) ABSTRACT

A micro-miniature switch apparatus (10) includes a substrate (12) having a surface (14) with first and second channels (16, 18) extending from the surface (14) into the substrate (12). The first and second channels (16, 18) are spaced apart from each other, with a channel axis (20) extending longitudinally through the first and second channels (16, 18). A body (68) that is movable relative to the substrate (12) includes two arms (70, 72). Each of the arms (70, 72) extends into one of the first and second channels (16, 18) to support the body (68) for movement relative to the substrate (12) between first and second electrical conditions of the switch apparatus (10).

21 Claims, 4 Drawing Sheets

MICRO-MINIATURE SWITCH APPARATUS

TECHNICAL FIELD

The present invention relates to a switch apparatus and, more particularly, to a micro-miniature switch apparatus that may be manufactured using a semiconductor fabrication technique.

BACKGROUND OF THE INVENTION

High speed switch devices are used in various technologies, including, for example, automotive safety systems and microwave relay systems. In each of these systems, switch devices must operate reliably and at high frequencies.

In a vehicle safety system, for example, inertia-operated mechanical switches often are used to sense the onset of a vehicle crash event and trigger the actuation of an occupant protection device (e.g., an air bag or a seat belt pretensioner). More recently, vehicles are being equipped with one or more electronic acceleration sensors working in cooperation with a microprocessor and sophisticated software. The sensors provide electronic signals proportional to sensed vehicle acceleration. The microprocessor assesses the changes in the vehicle's acceleration to determine whether the signal indicates that a vehicle crash event is in progress that requires actuation of the occupant protection system.

Safing switches often are used in combination with acceleration sensors to provide a redundant level of detection for a vehicle crash event. The safing switch usually is designed and calibrated to close at a relatively early stage in a crash event. The occupant protection device (e.g., an air bag or seat belt pretensioner) is only actuated when the safing switch is closed and the microprocessor determines that the severity of the crash is sufficient to warrant such actuation.

Safing switches may be manufactured by processes generally similar to those used to assemble other small mechanical devices. Efforts are being made, however, to develop smaller switches that could be manufactured using techniques like those used to manufacture semiconductor components and/or micro-machined silicon elements. Patents describing such micro-machined switch devices include U.S. Pat. Nos. 5,331,853 and 5,591,910.

U.S. Pat. No. 5,331,853 discloses an acceleration sensor micro-machined from a silicon substrate. The sensor includes pair of accelerometers, each having a force sensing axis. Each accelerometer includes a mass supported by micro-machined flexures connected to a support frame so as to permit movement of the mass relative to the substrate. Each accelerometer measures movement of. the associated mass so as to provide an output signal indicative of the sensed acceleration along its force-sensing axis.

U.S. Pat. No. 5,591,910 discloses a micro-machined acceleration sensor formed of an inertial mass supported above a substrate by flexure hinges. The inertial mass moves relative to the substrate when subjected to an acceleration perpendicular to the plane of the substrate. Movement of the mass results in a change in a capacitance value of the sensor. The changing capacitance value is indicative of acceleration.

Other examples of micro-machined switch devices and accelerometers are disclosed in U.S. Pat. Nos. 4,736,629; 4,882,933; 5,541,437; 5,635,739; and 5,804,783.

SUMMARY OF THE INVENTION

In accordance with one aspect, the present invention provides a micro-miniature switch apparatus that includes a substrate which has a surface. First and second channels extend from the surface into the substrate. The first and second channels are spaced apart from each other, with a channel axis extending longitudinally through the channels. A body that is movable relative to the substrate includes two arms. Each of the arms extends into one of the first and second channels to support the body for movement relative to the substrate between first and second electrical conditions of the switch apparatus.

In accordance with another aspect, the present invention provides a micro-miniature acceleration switch apparatus that includes a substrate which has a surface. A pair of channels extend from the surface into the substrate. Each of the channels has a channel axis, and each channel axis is parallel with the other channel axis. The apparatus also includes a body that is movable relative to the substrate. The body has two substantially coaxial arms. Each arm extends from a central part of the body into a bearing relationship with one of the first and second channels to support the body for movement relative to the substrate from a first switch position to a second switch position when the switch apparatus is accelerated in a direction substantially orthogonal to the surface of the substrate.

In accordance with yet another aspect, the present invention provides a micro-miniature acceleration switch apparatus that includes a substrate having a surface. Two fulcrum supports are formed at the surface of the substrate, with each of the fulcrum supports being spaced apart from the other fulcrum support. A body that is movable relative to the substrate includes a plate positioned near the surface of the substrate at a location between the fulcrum supports. The body also includes two substantially coaxial arms that extend from the plate into a bearing relationship with an associated one of the fulcrum supports to permit rocking movement of the body relative to the substrate. The body is movable relative to the substrate between first and second switch positions in response to acceleration of the switch apparatus in a direction orthogonal to the surface of the substrate.

BRIEF DESCRIPTION OF THE DRAWINGS

The foregoing and other features and advantages of the present invention will become more apparent to one skilled in the art upon consideration of the following description of and accompanying drawings in which.

DESCRIPTION OF A PREFERRED EMBODIMENT

Figure 1:
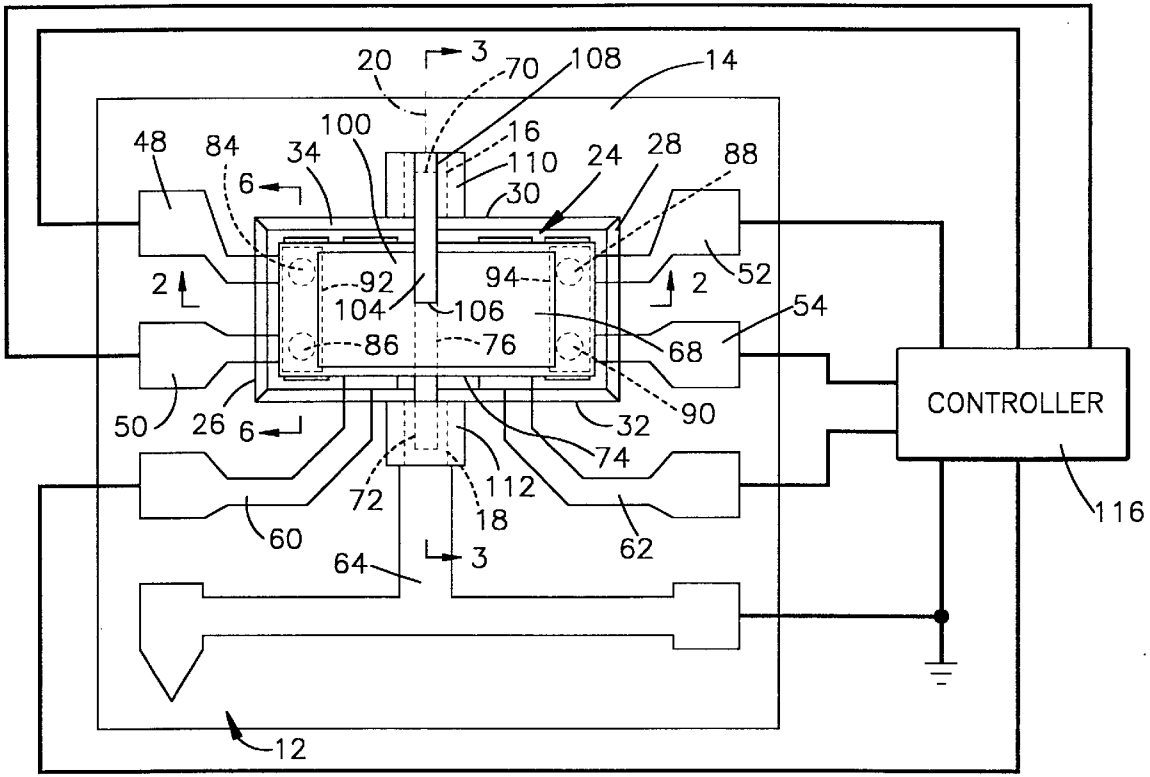
FIG. 1 is a top elevation of a switch apparatus in accordance with a preferred embodiment of the present invention.

A micro-miniature switch apparatus 10 in accordance with a preferred embodiment of the present invention is illustrated in FIG. 1. Briefly stated, the switch apparatus 10 includes a substrate 12 and a body 68. The body 68 is moveable relative to the substrate 12 between different switch conditions (e.g., see FIGS. 2, 7 and 8).

Figure 2:
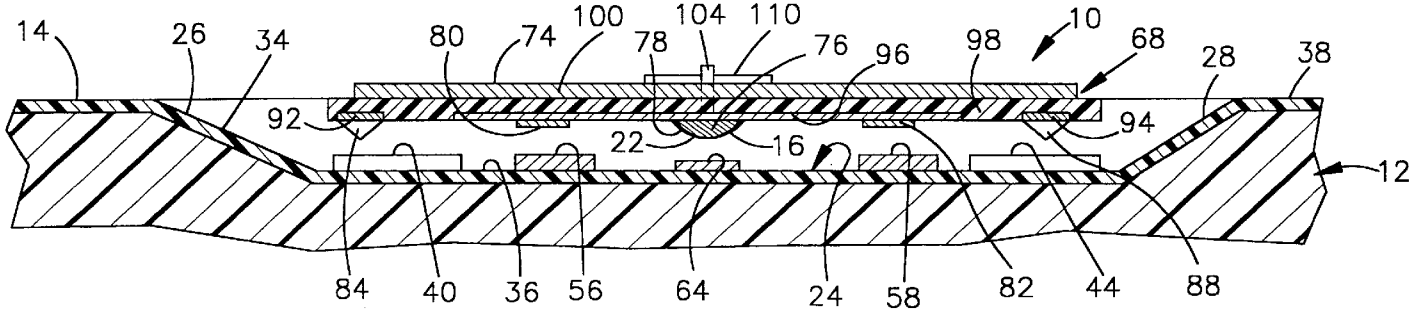
FIG. 2 is an enlarged sectional view taken along line 2—2 in FIG. 1.

Referring to FIG. 2, the substrate 12 has a substantially planar surface 14. The substrate 12, for example, may be a wafer of insulated indium phosphide, silicon, gallium arsenide, or other appropriate materials. In the illustrative embodiment described herein, a silicon substrate 12 is used.

It is to be noted that the substrate 12 may be composed of one or more layers. In the illustrated example, the substrate 12 has an under layer of silicon and an external layer 38 that is oxidized. Such layers may be the result of process steps that occur during making of the switch apparatus 10. For the purpose of simplicity, and not as a limitation, the substrate 12 is discussed herein as a unitary member. In addition, the relative dimensions of structure and material layers shown in the accompanying figures is for purposes of clarity of explanation and are not intended to be to scale, unless otherwise noted.

Figure 4:
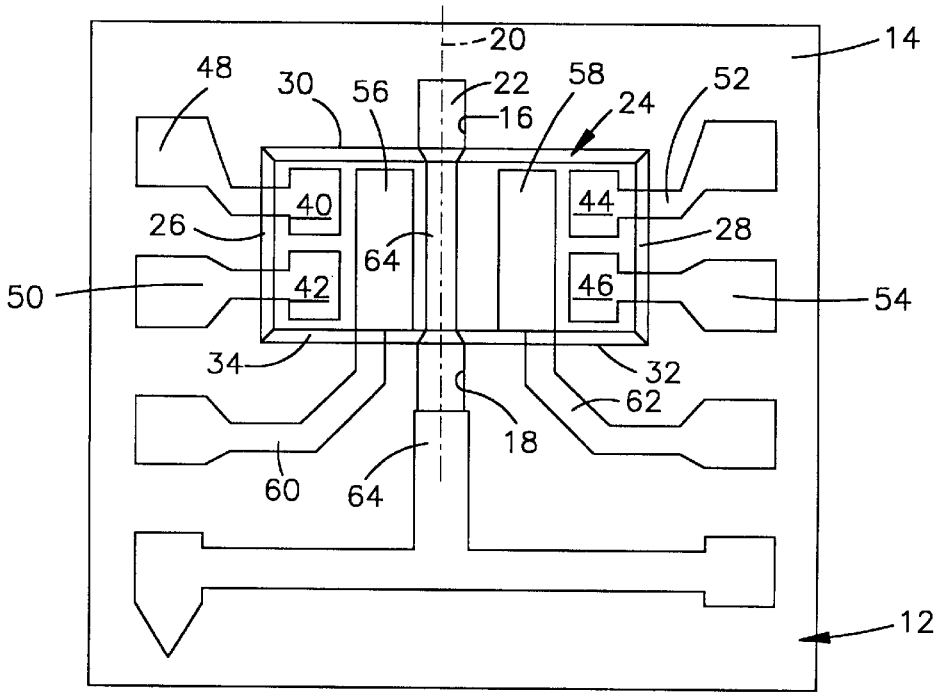
FIG. 4 is a top elevation of part of the apparatus of FIG. 1 with a portion of the apparatus removed to illustrate an intermediate fabrication step.

Referring to FIG. 4, first and second channels 16 and 18 extend a predetermined depth into the substrate 12 from the surface 14. The channels 16 and 18 are spaced apart and oriented parallel to each other. Preferably, a common channel axis 20 extends longitudinally through each of the channels. The channels 16 and 18 may be formed in the substrate 12 by any of several techniques. Examples of such techniques include wet or dry chemical etching, plasma etching, sputter etching, and reactive ion etching.

Preferably, the channels 16 and 18 are chemically etched in the substrate 12 as a single elongated trough to a depth of about 5 to 10 micrometers by a nonselective orientation etchant with an appropriately configured mask (FIG. 2). The etching forms the channels 16 and 18 to have a curved or semi-cylindrical sidewall surface 22 extending along the channel axis 20.

As shown in FIG. 4, a recess 24 also extends into the substrate 12 from the surface 14 a predetermined depth, which is greater than the depth of the channels 16 and 18 (see FIG. 2). For example, the substrate 12 is chemically etched down about 20 to 30 microns from the surface 14 (i.e., about 4–6 times greater than the depth of the channels 16 and 18) to form a generally rectangular recess 24.

The recess 24 has spaced apart ends 26 and 28 and opposed side edges 30 and 32 extending between the ends. The recess 24 is oriented in an overlapping relationship with the trough defined by channels 16 and 18 so that the channels extend from and intersect the respective side edges 30 and 32. While the recess 24 is shown as being rectangular, it alternatively could be formed of different shapes, such as circular, elliptical, trapezoidal, etc.

The recess 24 also includes a perimeter sidewall portion 34 that extends from the substrate surface 14 to a generally planar recessed surface 36 located within the recess. Opposed edges of the sidewall portion 34 extend from the recessed surface 36 to the upper surface 14 of the substrate 12. The sidewall portion 34 of the recess could be slanted, as shown in FIG. 2, or curved relative to the surface 14.

The sidewall 22 of each channel 16, 18 intersects the sidewall portion 34 of the recess 24 at a respective adjacent side edge 30, 32 of the recess 24. Preferably, the location of intersection of each channels 16, 18 with the sidewall portion 34 is not equidistant from the ends 26 and 28 of the recess 24.

After the recess 24 and channels 16 and 18 are formed, the exposed surface of the silicon wafer is thermally oxidized, such as by heating the substrate in the presence of water vapor. This results in the layer of thermal oxidation 38.

Referring to FIG. 4, the switch apparatus 10 also includes electrical contact pads 40, 42, 44, and 46 disposed on the recessed surface 36 of the recess 24 over the thermal oxidation layer 38. The contact pads 40, 42, 44 and 46 are formed of electrically conductive material arranged in associated pairs 40, 42 and 44, 46. Each pair 40, 42 and 44, 46 is located near a respective end 26 and 28 of the recess 24.

An electrical trace or transmission line 48, 50, 52, 54 extends from each of the respective electrical contact pads 40, 42, 44, 46 to a corresponding location external to the recess 24. The transmission lines 48, 50, 52, and 54, for example, correspond to pin terminals of the micro-miniature switch apparatus 10. The electrical condition of each of the contact pads 40, 42, 44, 46 may be monitored through each of the pins associated with transmission lines 48, 50, 52, 54, respectively.

In addition to the electrical contact pads 40, 42, 44, and 46, at least one and preferably two elongated conductive plates 56 and 58 also are disposed on the planar surface 36 within the recess 24. Each of the plates 56, 58 are spaced apart from each other and are located on opposite sides of the channel axis 20. Preferably, each of the plates 56, 58 is located between the channel axis 20 and an adjacent pair of contact pads 40, 42 and 44, 46, as shown in FIG. 4. An electrically conductive transmission line 60, 62 is connected to and extends from each corresponding plate 56, 58 to a location external to the recess 24. The transmission lines 60 and 62 are connected to respective pin terminals of the switch apparatus 10. Each of the conductive plates 56, 58 is operative to provide an electrostatic field in response to electrical current provided through its corresponding transmission line 60, 62.

An additional transmission line 64 preferably extends from channel 16 to channel 18, traversing the recess 24, and extends to a location external to the channels and recess. The transmission line 64 may be electrically connected to a reference voltage potential through an associated pin terminal of the switch apparatus 10.

The contact pads 40, 42, 44, and 46, the conductive plates 56 and 58, and the transmission lines 48, 50, 52, 54, 60, 62, and 64 are formed of electrically conductive materials, such as metal, e.g., titanium, gold, or platinum. The electrically conductive materials are applied, for example, by evaporating the metal at desired pattern locations with a mask using a known evaporation and lift-off technique.

Referring to FIGS. 1 and 2, the body 68 of the switch apparatus 10 is located at the recess 24 and is movable into and out of engagement with the electrical contact pads 40, 42, 44, and 46 disposed in the recess 24. The body 68 includes two arms 70 and 72 that extend outwardly from a central plate portion 74 of the body. The plate portion 74 is dimensioned and configured according to the dimensions and configuration of the recess 24. The plate portion 74 defines an inertial mass of the body 68.

Figure 5:
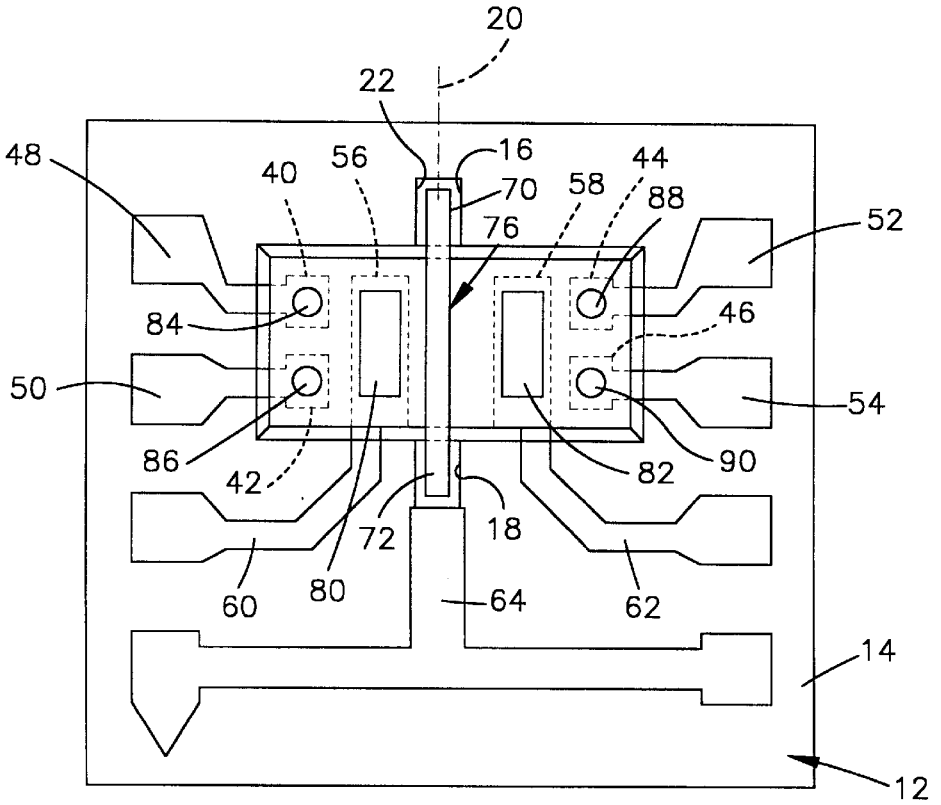
FIG. 5 is a view similar to FIG. 4 with a portion of the apparatus removed to illustrate a step in the fabrication process subsequent to that shown in FIG. 4.

Referring to FIGS. 2 and 5, the central plate portion 74 includes a pair of lower plates 80 and 82 that are spaced apart from each other and located on opposite sides of the channel axis 20. Each of the electromagnetic plates 80, 82 is aligned with one of the conductive plates 56, 58 (see FIG. 5) and is responsive to the electrostatic field provided by the corresponding conductive plate 56, 58. The plates 80 and 82 are formed of an electromagnetic material, such as iron cobalt, nickel cobalt, lead zirconate titanate (PZT) or another appropriate electromagnetic material.

The central plate portion 74 also includes contact bumps 84, 86, 88, and 90. Each of the contact bumps 84, 86, 88, 90 is aligned for contact with a respective one of the electrical contact pads 40, 42, 44, 46. The bumps 84, 86, 88, and 90 are formed of an electrically conductive material, such as gold or a combination of nickel and gold. Preferably, each of the bumps 84, 86, 88, 90 has a conical configuration with a pointed end extending toward a respective one of the contact pads 40, 42, 44, 46.

The arms 70 and 72 define the end portions of an elongated fulcrum rod 76 oriented parallel with the channel axis 20 and fixed relative to the central plate portion 74. The fulcrum rod 76 extends from one channel 16 to the other channel 18. In particular, the arms 70 and 72 extend into and engage the sidewall 22 of the respective channels 16 and 18, shown in FIGS. 2 and 5. The fulcrum rod 76 is formed of a rigid material, such as a metal, for example, nickel and aluminum or only aluminum.

Preferably, at least part of the arms 70 and 72 have a curved or semi-cylindrical lower surface 78 that approximates the contour of the semi-cylindrical sidewall 22 of the respective channels 16 and 18 (FIG. 2). The curved lower surface 78 of the arms 70 and 72 rests in a bearing relationship with the sidewall surface 22 of the channels 16 and 18 so as to support the body 68 for movement relative to the substrate 12. This movement occurs as a result of rocking or sliding between the lower surface 78 of the arms 70 and 72 and the sidewall 22 of the associated channels 16 and 18.

Figure 6:
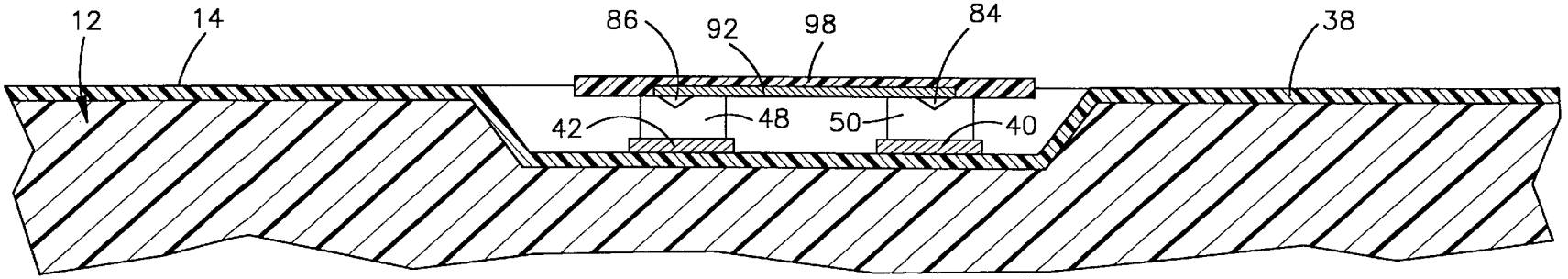
FIG. 6 is a sectional view taken along line 6—6 in FIG. 1.

Electrodes 92 and 94 (FIGS. 2 and 6) are located near opposed ends of the central plate portion 74. Each electrode 92, 94 is disposed between the central plate portion 74 and each pair of contact bumps 84, 86 and 88, 90, respectively. The electrodes 92 and 94 are made of an electrically conductive material and electrically connect the contact bumps 84, 86, 88, 90 of each bump pair 84, 86 and 88, 90. Each electrode 92, 94 is preferably formed of a layer of gold and a layer of nickel with an overall thickness of about five microns.

An electrically conductive plate 96, also preferably formed of gold and nickel, is disposed over the electromagnetic plates 80 and 82 and a central portion of the elongated rod 76, as shown in FIG. 2. The plate 96 electrically connects the electromagnetic plates 80 and 82 and the rod 76 to help improve the responsiveness of the switch apparatus 10.

Referring to FIG. 2, the majority of the central plate portion 74 is formed of a relatively thick layer of a dielectric material 98 deposited over the top electrodes 92 and 94 and the electrically conductive plate 96. The dielectric layer 98, for example, may be formed of silicon oxide (silox), nitride or a stack consisting of silox/nitride/silox. The dielectric layer 98 electrically isolates the electrodes 92 and 94 and the plate 96 as well as adds mass to the central plate portion 74.

Because the dielectric layer 98 may lack sufficient rigidity, however, a reinforcement layer 100 of a rigid material, such as nickel and/or gold, preferably is disposed over a substantial part of the dielectric layer 98 to provide additional desired rigidity to the central plate portion 74 (FIG. 1). Alternatively, several smaller plates may be disposed over the dielectric layer to provide additional rigidity.

Figure 3:
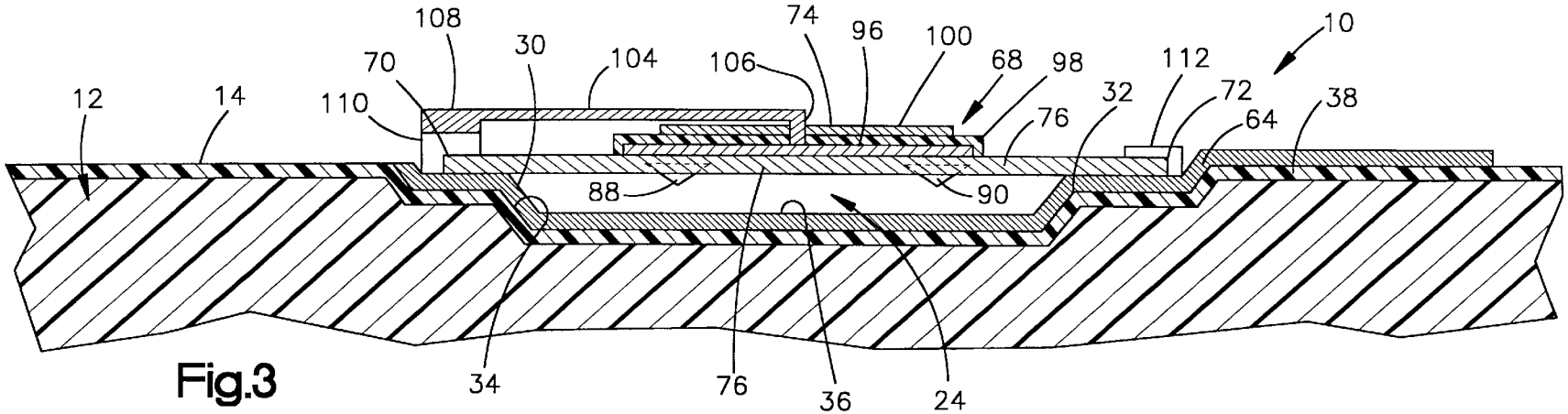
FIG. 3 is an enlarged sectional view taken along line 3—3 in FIG. 1.

As shown in FIG. 3, the apparatus 10 also preferably includes a resilient flexure 104 that is connected with the central plate portion 74 and fixed relative to the substrate 12. The flexure advantageously provides torsional resistance to movement of the body 68 relative to the substrate 12. Preferably, the flexure 104 is formed of a resilient material, such as nickel or another metal. One end 106 of the flexure 104 is connected to a central part of the plate 74. The end 106 may be connected to the plate 96 or the fulcrum rod 76, such as extending through an aperture which has been etched through both the reinforcement layer 100 and the dielectric layer 98. Another end 108 of the flexure 104 is fixed relative to the substrate 12, preferably attached to a reinforcement layer 110 fixed to the surface 14 of the substrate on opposed sides of the channel 16. Another reinforcement layer 112 is fixed to the surface 14 of the substrate on opposed sides of the channel 18. The reinforcement layers 110 and 112 also operate to hold the arms 70 and 72 within the respective channels 16 and 18, shown in FIG. 1.

The flexure 104 provides torsional resistance to movement of the body 68 relative to the substrate as well as stabilizes the body relative to the substrate 12. In addition, the flexure 104 operates to electrically connect the plate 96 to the transmission line 64 that extends longitudinally through the channels 16 and 18. Accordingly, the plate 96 of the switch 10 may be connected to a desired voltage potential, such as electrical ground, through the transmission line 64.

After the various reinforcement layers 100, 110, and 112 and the air bridge 104 have been added, any remaining sacrificed layers are removed so that the sidewall portion 22 of the channels 16 and 18 engages the curved lower surface 78 of each of the arms 70 and 72. This engagement may permit a sliding or rocking contact between the arms 70 and 72 and the sidewall portion 22 to provide for desired movement of the body 68 relative to the substrate 12 between first and second electrical conditions of the switch apparatus 10 (see FIGS. 7 and 8). The arms 70 and 72 act as a hinge rotating within the respective channels 16 and 18.

When the switch apparatus 10 is configured to provide rocking movement, for example, the contact between the curved surface 78 of the arms 70 and 72 and the sidewall surface 22 of the channels 16 and 18 defines an axis of rotation for the body 68. This axis of rotation is substantially parallel to the channel axis 20 and may move along the sidewall 22 depending on the amount of relative rotation between the body 68 and the substrate 12.

Figure 7:
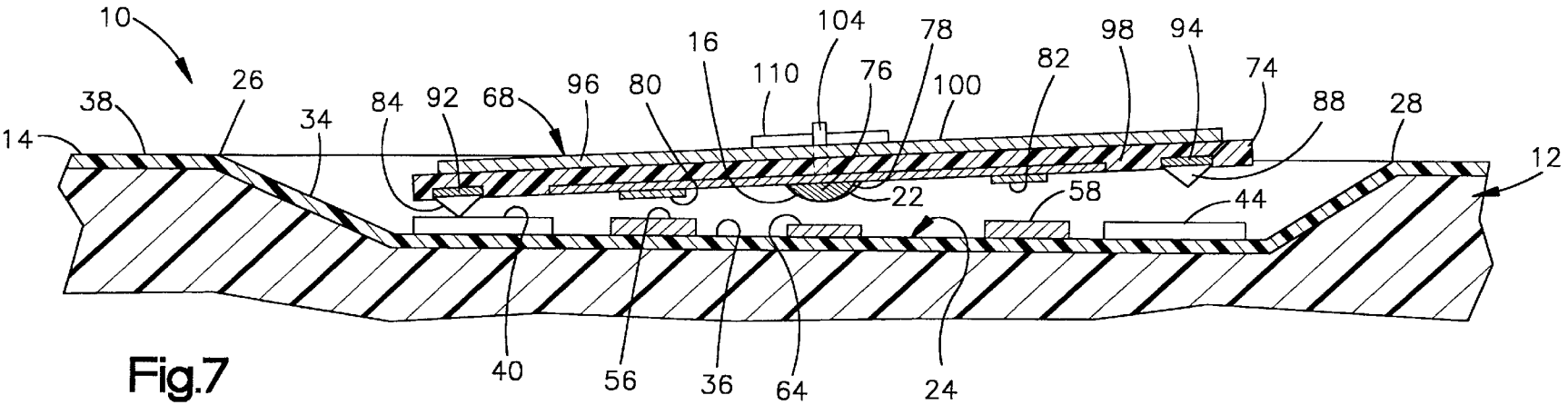
FIG. 7 is a view similar to FIG. 2, but illustrates a condition of the switch apparatus.
Figure 8:
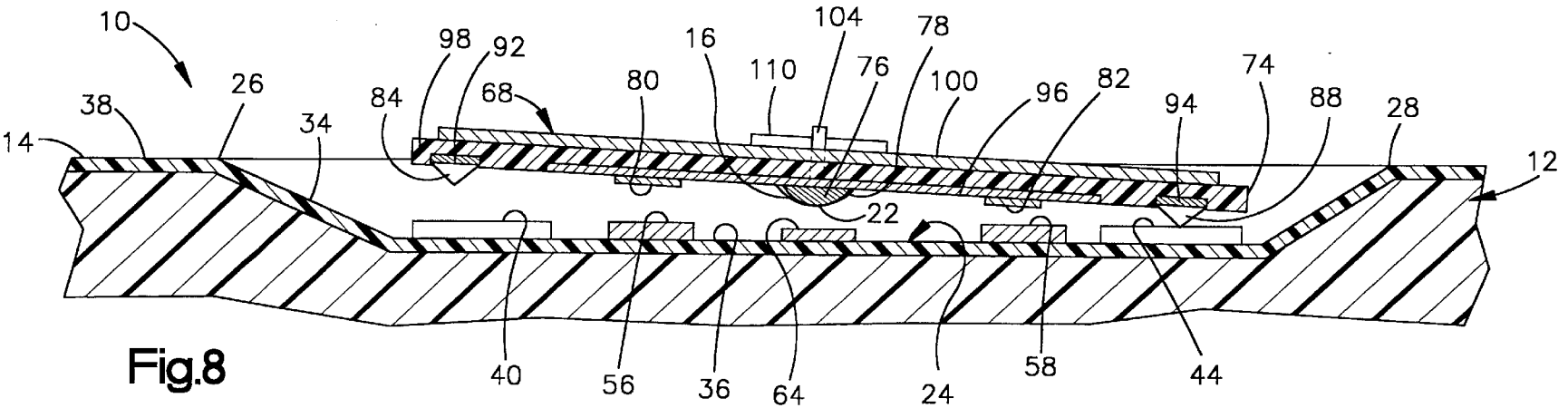
FIG. 8 is a view similar to FIG. 7, but illustrates a different condition of the switch apparatus.

The operation of the switch apparatus 10 will be better appreciated with reference to FIGS. 7 and 8. Switch conditions are provided in response to a pair of contact bumps 84, 86 or 88, 90 electrically connecting the associated pair of contact pads 40, 42 or 44, 46. As stated above, each of the conductive plates 56 and 58 may be energized with a selected amount of electric current to provide an electrostatic field that urges the adjacent portion of the central plate portion 74 toward or away from the energized conductive plate. Advantageously, the electromagnetic plates 80 and 82 are responsive to electrostatic field to help improve the performance and responsiveness of the switch apparatus 10, such as when either of the conductive plates 56 or 58 is energized. One or both of the electrically conductive plates 56 and 58 may be energized in a predefined manner for testing the operation of the switch apparatus 10.

When the conductive plate 56 is energized, for example, it generates an electrostatic field that urges the adjacent part of the central plate 74 into the recess 24 toward the energized plate. This causes the contact bumps 84 and 86 to engage the associated electrical contact pads 40 and 42, thereby completing an electrical circuit defined by the electrical contact pads and their corresponding transmission lines 48 and 50, as shown in FIG. 7. The connection between pads 40 and 42 defines a first switch condition that may be monitored.

Similarly, the other electrically conductive plate 58 also may be energized to provide an electrostatic force that urges the other end of the body 68 toward the lower energized plate within the recess 24. This results in the contact bumps 88 and 90 engaging the pads 44 and 46, thereby electrically connecting contact pads through the plate 94, as shown in FIG. 8, to define another switch condition. The electrical condition of the contact pads 44 and 46 may be monitored through lines 52 and 54. Accordingly, the electrical condition of each pair of pads 40, 42 and 44, 46 may be monitored to detect a change in condition of the switch apparatus 10. In addition or alternatively, the switch position, as defined by the electrical condition of the pads 40, 42, 44, and 46, may be controlled to effect a change in switch condition.

Because the amount of electrostatic field is variable based on the electrical current provided through transmission lines 60 and 62, one of the electrically conductive plates 56 or 58 may be energized to inhibit movement of the body 68 from one condition, such as shown in FIG. 7, to another condition, such as shown in FIG. 8. The electrical current and, in turn, the electrostatic field may be controlled to inhibit such movement when the switch apparatus 10 is exposed to less than a predetermined amount of acceleration along a direction substantially orthogonal to the surface 14 of the substrate 12. However, if the switch apparatus is sufficiently accelerated along a direction orthogonal to the surface 14 of the substrate 12, the body 68 overcomes the electrostatic field and moves from the electrical condition shown in FIG. 7 to the other condition shown in FIG. 8.

Simply breaking an electrical connection between a pair of pads 40, 42 or 44, 46 may indicate a change in switch condition, such the neutral position shown in FIG. 2. This is advantageous for detecting acceleration of the switch apparatus 10 above a threshold defined by the amount of force provided by a controlled electrostatic field. In addition to the plates 56 and 58 which operate to urge an end of the body toward the recessed surface 36 of the substrate 12, the body 68 may be asymmetric so that a greater mass is on one side of the arms 70 and 72. This also will provide additional resistance to movement of the body 68 relative the substrate 12. Accordingly, such asymmetry in the body 68 must be considered when implementing the switch apparatus 10 as an acceleration safing switch.

In view of the foregoing, a switch apparatus 10 in accordance with the present invention may be used as a safing switch or acceleration sensing device. The surface 14 is oriented orthogonal to the direction along which acceleration is to be sensed. The switch apparatus 10 thus is able to detect a vehicle for sensing a vehicle crash event in when the vehicle is accelerated along a direction substantially orthogonal to the surface 14 of the substrate 12. A plurality of such switch devices further may be used to detect acceleration above a threshold along one or more selected directions.

In order to monitor the switching conditions of the apparatus 10, the transmission lines 48, 50, 52, and 54 may be electrically connected to external circuitry, such as a controller 116, schematically illustrated in FIG. 1. The controller 116, for example, may be microprocessor or microcontroller programmed to detect a change in the electrical condition of the switch apparatus 10. The controller 110 further may be part of the control circuitry for a vehicle occupant protection system. The controller is operative to control actuation of an associated vehicle occupant protection device, such as an air bag or seat belt pretensioner (not shown).

The controller 116 is connected to the conductive plates 56 and 58 through transmission lines 60 and 62 to control the electrostatic forces provided thereby. Accordingly, the controller 116 is operative to control the level of acceleration sufficient to change switch conditions, such as from the electrical condition of FIG. 7 to the condition of FIG. 8.

The switch apparatus 10 may be fabricated using semiconductor fabrication techniques. As stated above, the channels 16 and 18 as well as the recess 24 are formed through known etching techniques.

In order to provide separation between the body 68 and the components 40–44, 56 and 58 disposed within the recess, one or more sacrificed layers preferably are applied over such components prior to fabrication of the body. The sacrificed layer may be, for example, a metal layer, such as a layer of aluminum or copper ranging in thickness from about 5 microns to about 10 microns.

After depositing the sacrificed layer, the constituent parts of the body 68, as described above, are formed by depositing selected materials over the sacrificed layer and the previously formed parts that are fixed to the substrate 12. The electromagnetic plates 80 and 82, for example, are formed by etching part of the sacrificed layer with a mask having appropriately sized apertures at desired locations aligned with the conductive plates 56 and 58. The electromagnetic material is then deposited in the etched areas to form the electromagnetic plates 80 and 82. During fabrication, the plates 80 and 82 are separated from conductive plates 56 and 58 by a distance defined by the thickness of the sacrificed layer.

After forming the electromagnetic plates 80 and 82, the recess 24 preferably is planarized with a suitable planarizing agent, such as polymethyl methacrylate (PMMA). The planarizing agent further helps to separate the body 68 from the substrate 12 and components affixed thereto in a manner similar to the previously applied sacrificed layer.

Preferably, the contact bumps 84, 86, 88, and 90 and the fulcrum rod 76 are formed in a common fabrication step using a single mask, such as after the electromagnetic plates 80 and 82 and PMMA layer have been applied. The bumps 84, 86, 88 and 90 are formed, for example, by partially etching the previously applied PMMA layer to define corresponding conical voids at desired locations aligned with the contact pads 40, 42, 44, and 46 in which the desired electrically conductive material is deposited. Similarly, the fulcrum rod 76 is formed by partially etching the PMMA and part of the sacrificed layer to define a longitudinal groove aligned with the channel axis at a location above the channels 16 and 18.

The contact bumps 84, 86, 88, and 90 and the fulcrum rod 76 are formed in the corresponding voids over the thin sacrificed layer by plating a relatively thick layer of metal, such as about ten microns of gold and/or nickel. Each of the contact bumps 84, 86, 88, and 90 is oriented and configured so as to engage the underlying electrical contacts 40, 42, 44, and 46 upon corresponding movement of the body 68 relative the substrate 12, after the fabrication process is completed. To help alleviate the possibility of the fulcrum rod 76 and the bumps 84, 86, 88, and 90 from bonding or adhering to the substrate 12 or contact bumps 84, 86, 88 and 90, a thin sacrificed layer, about two microns thick, may be applied prior to plating the fulcrum rod and the contact bumps to provide desired separation.

From the above description of the invention, those skilled in the art will perceive improvements, changes and modifications. Such improvements, changes and modifications within the skill of the art are intended to be covered by the appended claims.

Having described the invention, the following is claimed:

1. A micro-miniature switch apparatus comprising:

a substrate having a surface, first and second channels extending into said substrate from said surface of said substrate, said first and second channels being spaced apart from each other, a channel axis extending longitudinally through said first and second channels; and a body moveable relative said substrate, said body including two arms, each of said arms extending into one of said first and second channels to support said body for rocking movement relative to said substrate between first and second electrical conditions of said switch apparatus.

2. A switch apparatus as set forth in claim 1 further including a recess extending from said surface into said substrate, said recess having a pair of opposed side edges, each of said first and second channels extending longitudinally from one of said opposed side edges of said recess.

3. A switch apparatus as set forth in claim 2 further including a first electrical contact disposed on said substrate within said recess adjacent a first end of said recess, a second electrical contact being formed on said body for electrically connecting with said first electrical contact when said switch apparatus is in one of said first and second electrical conditions.

4. A switch apparatus as set forth in claim 3 wherein said switch apparatus, in response to the rocking movement of said body relative to said substrate, provides a switched output signal having an electrical characteristic indicative of the electrical condition of said switch apparatus.

5. A switch apparatus as set forth in claim 2 wherein said recess is formed in said substrate to a first depth and said first and second channels are formed in said substrate to a second depth which is less than said first depth.

6. A switch apparatus as set forth in claim 5 wherein each of said channels is defined by an elongated sidewall surface of said substrate curved about the channel axis, at least part of each of said two arms being curved to rockingly engage said sidewall surface of said substrate at the associated one of said first and second channels, thereby facilitating rocking movement of said body relative to said substrate.

7. A switch apparatus as set forth in claim 1 wherein said body is moveable relative said substrate from a first position that defines the first electrical condition to a second position that defines the second electrical condition when said switch apparatus is sufficiently accelerated along a direction substantially orthogonal to said surface of said substrate.

8. A switch apparatus as set forth in claim 7 wherein a conductive plate is disposed on said substrate, said conductive plate being operative to provide an electrostatic field that urges said body to the first position that defines the first electrical condition.

9. A switch apparatus as set forth in claim 8 wherein the electrostatic field provided by said conductive plate inhibits movement of said body relative to said substrate when said switch apparatus is exposed to less than a predetermined amount of acceleration along a direction substantially orthogonal to said surface of said substrate.

10. A switch apparatus as set forth in claim 9 further including external control means electrically connected with said conductive plate to control the electrostatic field provided by said conductive plate.

11. A switch apparatus as set forth in claim 1 further including an elongated flexure connected to said body and fixed relative to said substrate for providing torsional resistance to the rocking movement of said moveable plate.

12. A switch apparatus as set forth in claim 1 further including a recess extending from said surface of said substrate into said substrate, said recess having opposed side edges, each of said first and second channels extending longitudinally from one of said opposed side edges of said recess, a pair of conductive plates disposed on said substrate within said recess, each of said conductive plates being operative to provide an electrostatic field to effect corresponding movement of said body relative to said substrate toward one of said first and second electrical conditions of said switch apparatus.

13. A micro-miniature acceleration switch apparatus comprising:

a substrate having a surface, first and second channels extending from said surface of said substrate into said substrate, each of said channels having a channel axis that is parallel with the other channel axis; and a body moveable relative to said substrate, said body including two substantially coaxial arms, each of said arms extending from a central part of the body into a bearing relationship with one of said first and second channels to support said body for rocking movement relative to said substrate from a first switch position to a second switch position when said switch apparatus is accelerated in a direction substantially orthogonal to said surface of said substrate.

14. A switch apparatus as set forth in claim 13 further including a recess extending from said surface of said substrate into said substrate, a first electrical contact being disposed on said body, second and third electrical contacts being disposed on said substrate within said recess and spaced apart from each other, said first electrical contact electrically connecting said second and third electrical contacts when said body is in the second switch position, at least part of said body being located within said recess when said body is in the second switch position.

15. A switch apparatus as set forth in claim 13 further including a recess extending from said surface of said substrate into said substrate at a location between said channels, said recess having opposed sidewall portions that extend from said surface a depth into said substrate, each of said channels extending into said substrate a depth which is less than the depth of said sidewall portions of said recess.

16. An apparatus as set forth in claim 15 wherein each of said channels is defined by a longitudinally extending semi-cylindrical surface formed in said substrate from said surface of said substrate about the associated channel axis, said semi-cylindrical surface of each of said channels intersecting one of said opposed sidewall portions of said recess.

17. A switch apparatus as set forth in claim 16 wherein each of said arms has an elongated curved sidewall surface supported in bearing relationship by said semi-cylindrical surface of the associated one of said channels to facilitate rocking movement of said body relative to said substrate.

18. A switch apparatus as set forth in claim 13 further including a recess extending from said surface of said substrate into said substrate, said recess having first and second spaced apart ends, a conductive plate being disposed within said recess adjacent one of said ends of said recess, said conductive plate being operative to provide an electrostatic field that urges part of said body toward said substrate to define the switch first position.

19. A switch apparatus as set forth in claim 18 wherein said conductive plate is operative to provide a variable electrostatic field that defines an amount of acceleration which is sufficient to effect movement of said moveable plate from the first switch position to the switch second position.

20. A micro-miniature acceleration switch apparatus comprising:

a substrate having a surface, two fulcrum supports formed in said substrate adjacent said surface of said substrate, each of said fulcrum supports being spaced apart from the other of said fulcrum supports;

a body moveable relative to said substrate, said body comprising:

a plate positioned adjacent said surface of said substrate intermediate said fulcrum supports; and two substantially coaxial arms, each of said arms extending longitudinally from said plate into a bearing relationship with an associated one of said fulcrum supports to permit rocking movement of said body relative said substrate, said body being moveable relative to said substrate between first and second switch positions of said switch apparatus in response to acceleration of said switch apparatus in a direction orthogonal to the surface of said substrate.

21. A switch apparatus as set forth in claim 20 wherein each of said fulcrum supports is a channel having an elongated curved sidewall extending from said surface of said substrate into said substrate substantially parallel with said surface, each of said arms being in a bearing relationship with said curved sidewall of the associated said channels to provide for rocking movement of said body relative said substrate.

* * * * *